US011091954B2

(12) United States Patent
Lei et al.

(10) Patent No.: US 11,091,954 B2
(45) Date of Patent: Aug. 17, 2021

(54) CURTAIN AND DRAWSTRING ADJUSTMENT DEVICE THEREOF

(71) Applicant: Leafy Windoware Co., Ltd., Dongguan (CN)

(72) Inventors: Zhenbang Lei, Guangdong (CN); Xingbang Lei, Guangdong (CN)

(73) Assignee: Leafy Windoware Co., Ltd., Dongguan (CN)

( * ) Notice: Subject to any disclaimer, the term of this patent is extended or adjusted under 35 U.S.C. 154(b) by 157 days.

(21) Appl. No.: 16/367,264

(22) Filed: Mar. 28, 2019

(65) Prior Publication Data

US 2019/0316412 A1 Oct. 17, 2019

(30) Foreign Application Priority Data

Apr. 13, 2018 (CN) ..... 201820531852.7

(51) Int. Cl.

| | |
|---|---|
| ***E06B 9/322*** | (2006.01) |
| ***E06B 9/42*** | (2006.01) |
| ***E06B 9/262*** | (2006.01) |
| ***E06B 9/326*** | (2006.01) |
| *E06B 9/78* | (2006.01) |

(52) U.S. Cl.

CPC ..... *E06B 9/322* (2013.01); *E06B 9/326* (2013.01); *E06B 9/262* (2013.01); *E06B 9/42* (2013.01); *E06B 9/78* (2013.01); *E06B 2009/2622* (2013.01)

(58) Field of Classification Search

CPC .. E06B 9/322; E06B 2009/2622; E06B 9/262; E06B 9/326; B65H 75/48; B65H 75/4481

See application file for complete search history.

(56) References Cited

U.S. PATENT DOCUMENTS

| | | | | |
|---|---|---|---|---|
| 5,845,696 | A * | 12/1998 | Chou | E06B 9/36 160/178.1 V |
| 8,136,569 | B2 * | 3/2012 | Bohlen | E06B 9/42 160/323.1 |
| 8,366,033 | B2 * | 2/2013 | Chang | B65H 75/48 242/376 |
| 8,499,814 | B2 * | 8/2013 | Ng | E06B 9/324 160/173 R |
| 9,476,253 | B2 * | 10/2016 | Lai | E06B 9/326 |
| 10,774,583 | B1 * | 9/2020 | Chuang | E06B 9/78 |
| 2003/0111188 | A1 * | 6/2003 | Cross | A47H 3/08 160/84.01 |
| 2006/0108076 | A1 * | 5/2006 | Huang | E06B 9/322 160/176.1 R |

(Continued)

*Primary Examiner* — Phi D A

(57) ABSTRACT

An adjustment device for a drawstring of a curtain with a curtain body includes a base fixed to a bottom end of the curtain body and defining a shaft hole, a reel received and rotatably mounted in the shaft hole of the base, and a locking assembly for limiting an axial displacement of the reel. A sidewall bounding the shaft hole of the base defines a through slot. The base forms a number of first positioning portions distributed in a circle about a central axis of the shaft hole. An end of the drawstring passes through the through slot of the sidewall bounding the shaft hole and is wound on the reel. The reel forms a number of second positioning portions cooperating with the first positioning portions to prevent the reel from rotating.

12 Claims, 6 Drawing Sheets

(56) References Cited

U.S. PATENT DOCUMENTS

| | | | | |
|---|---|---|---|---|
| 2007/0107857 | A1* | 5/2007 | Wang | E06B 9/78 160/321 |
| 2009/0205788 | A1* | 8/2009 | Cannaverde | E06B 9/322 160/168.1 R |
| 2014/0359976 | A1* | 12/2014 | Lu | E06B 9/42 24/116 A |
| 2015/0152681 | A1* | 6/2015 | Chou | E06B 9/322 242/389 |

* cited by examiner

CURTAIN AND DRAWSTRING ADJUSTMENT DEVICE THEREOF

BACKGROUND OF THE INVENTION

1. Field of the Invention

The present invention relates to curtain technology and, more particularly to a curtain and a drawstring adjustment device thereof.

2. Description of Related Art

Current retractable curtains, such as roman shades, are typically retracted by drawstrings that are located at opposite sides of the curtains. A top end of each drawstring is attached to a corresponding winding reel of the curtain, and the drawstring is controlled to be wound or unwound by a retracting device. A bottom end of each drawstring is attached to a bottom end of the curtain. Through visual inspection and experience, a length of each drawstring (the length in this article referring specifically to the length that the drawstring can be extended in the curtain) is adjusted by adjusting a connection position of the bottom end of the drawstring and the curtain, so that, the lengths of the drawstrings are uniform. Otherwise, different lengths of the drawstrings may cause the heights of the opposite sides of the curtain to be different and the curtain is unbalanced. Moreover, in actual installation and use, it is necessary to adjust the lengths of the drawstrings according to the differences of the curtains, thus, there is a need for a curtain that can easily adjust the lengths of the drawstrings.

SUMMARY OF THE INVENTION

Therefore, the technical problem to be solved by the embodiments of the present invention is to provide a drawstring adjustment device, which can easily adjust lengths of drawstrings of a curtain.

Furthermore, the technical problem to be solved by the embodiments of the present invention is to provide a curtain, which can easily adjust lengths of drawstrings of the curtain.

To solve the above-mentioned technical problems, an embodiment of the present invention provides an adjustment device for a drawstring of a curtain with a curtain body. The adjustment device includes a base fixed to a bottom end of the curtain body and defining a shaft hole, a reel received and rotatably mounted in the shaft hole of the base, and a locking assembly for limiting an axial displacement of the reel. A sidewall bounding the shaft hole of the base defines a through slot. The base forms a plurality of first positioning portions distributed in a circle about a central axis of the shaft hole. An end of the drawstring passes through the through slot of the sidewall bounding the shaft hole and is wound on the reel. The reel forms a plurality of second positioning portions cooperating with the plurality of first positioning portions to prevent the reel from rotating.

Furthermore, a core shaft extends in the shaft hole from a bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly includes a locking member, and a positioning holder; wherein an end of the locking member is fixed in the locking hole, and an opposite end of the locking member forms a head portion, an outer diameter of the head portion is greater than a diameter of the core shaft; the positioning holder is arranged between an outer sidewall of the core shaft and an inner sidewall bounding the hollow chamber of the reel, the inner sidewall bounding the hollow chamber of the reel forms a block adjacent to an insertion end of the reel, opposite ends of the positioning holder are respectively abutted against the block and the head portion of the locking member.

Furthermore, a core shaft extends in the shaft hole from a bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly includes a locking member; wherein an end of the locking member is fixed in the locking hole, and an opposite end of the locking member forms a head portion, an outer diameter of the head portion is greater than a diameter of an inner sidewall bounding the hollow chamber; the locking member is fixed in the locking hole, and the head portion of the locking member is abutted against an outer end wall of the reel.

Furthermore, the plurality of first positioning portions is arranged on a bottom wall bounding the shaft hole, and the plurality of second positioning portions is arranged on an end wall of an insertion end of the reel.

Furthermore, an end of the reel opposite to an insertion end of the reel is exposed outside the shaft hole, and forms an operation portion radially extending out.

Furthermore, the plurality of first positioning portions is arranged on a periphery bounding an orifice of the shaft hole, and the plurality of second positioning portions is arranged on a sidewall of the operation portion facing the base.

Furthermore, the plurality of first positioning portions is a plurality of positioning holes, and the plurality of second positioning portions is a plurality of positioning pins.

Furthermore, the locking member is a head screw, or the locking member includes a screw, and a ring sleeved on the screw to form the head portion.

Furthermore, the base includes a seat located at a bottom of the base to be fixed to the curtain body, and a sleeve extending from a top end of the seat, an inner chamber of the sleeve forms the shaft hole.

On the other hand, an embodiment of the present invention further provides a curtain including a curtain body, a drawstring to drive the curtain body to be retracted, a retraction device to retract the drawstring, and an adjustment device. The adjustment device includes a base fixed to a bottom end of the curtain body and defining a shaft hole, a reel received and rotatably mounted in the shaft hole of the base, and a locking assembly for limiting an axial displacement of the reel. A sidewall bounding the shaft hole of the base defines a through slot. The base forms a plurality of first positioning portions distributed in a circle about a central axis of the shaft hole. An end of the drawstring passes through the through slot of the sidewall bounding the shaft hole and is wound on the reel. The reel forms a plurality of second positioning portions cooperating with the plurality of first positioning portions to prevent the reel from rotating.

By adopting the above-mentioned technical solutions, the beneficial effects of the inventive embodiment of the present invention are at least as follows. The reel of the embodiment of the present invention is received and rotatably mounted in the shaft hole of the base, the end of the drawstring passes through the through slot defined in the sidewall bounding the shaft hole and is wound on the reel, the reel forms the plurality of second positioning portions cooperating with the plurality of second positioning portions of the base to prevent the reel from rotating, and the locking member limits the axial displacement of the reel to fix the length of the drawstring. When the length of the drawstring needs to be adjusted, the locking assembly is pulled out of the reel in a direction away from the base. The second positioning portions of the reel are disengaged from the first positioning portions of the base. The reel is rotated to adjust the position of the drawstring on the reel, until the length of the drawstring reaches the desired length. The second positioning portions of the reel wound with the drawstring are engaged in the first positioning portions of the base again. The locking assembly is locked. Because the limitation of the first positioning portions to the reel, the bottom end of the drawstring is fixed, and the drawstring keeps a desired length. Therefore, the length of the drawstring can be conveniently adjusted, to realize the retraction of the curtain body.

DETAILED DESCRIPTION OF THE INVENTION

The present application will be further described in detail below with reference to the accompanying drawings and specific embodiments. It should be understood that the following illustrative embodiments and illustrations are only used to explain the present invention and are not intended to limit the invention, and that the features of the embodiments and embodiments of the present application may be combined with each other.

Figure 1:
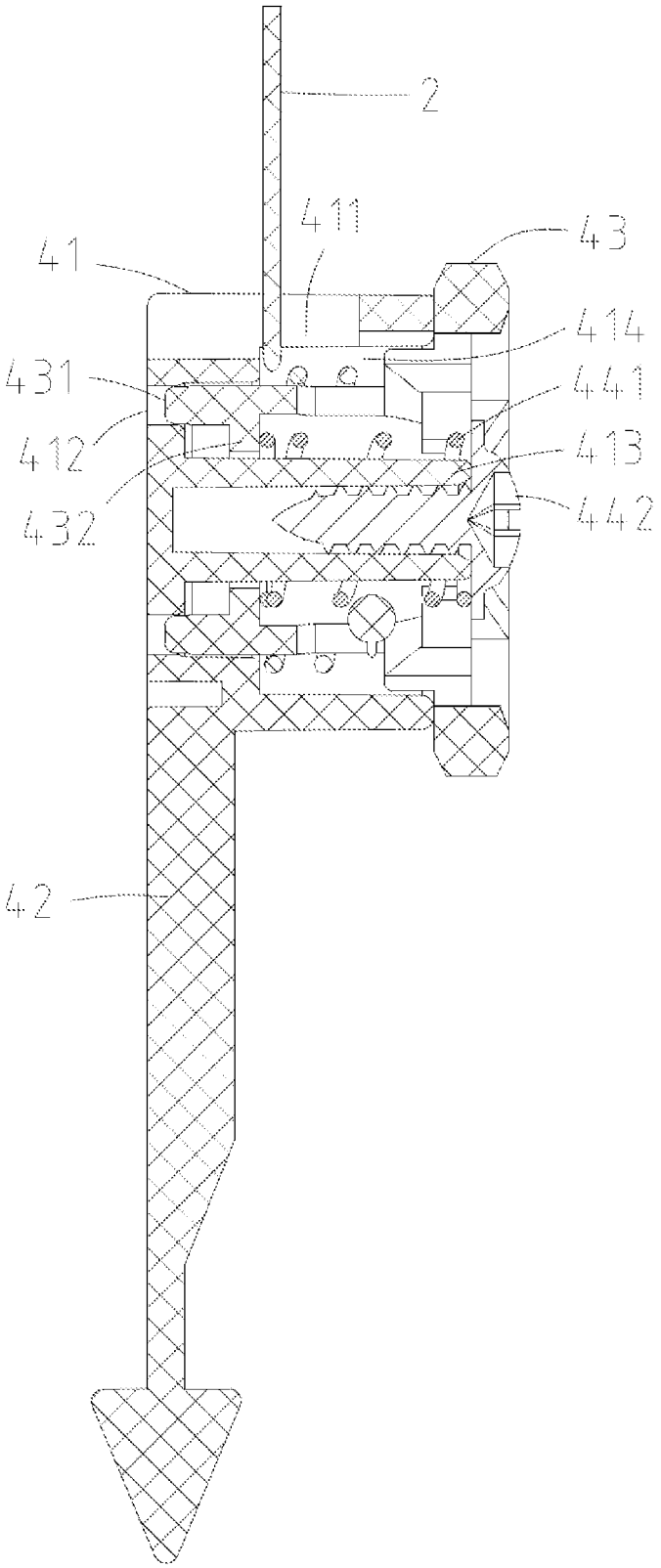
FIG. 1 is a cross-sectional view of a drawstring adjustment device of an embodiment of the present invention.
Figure 2:
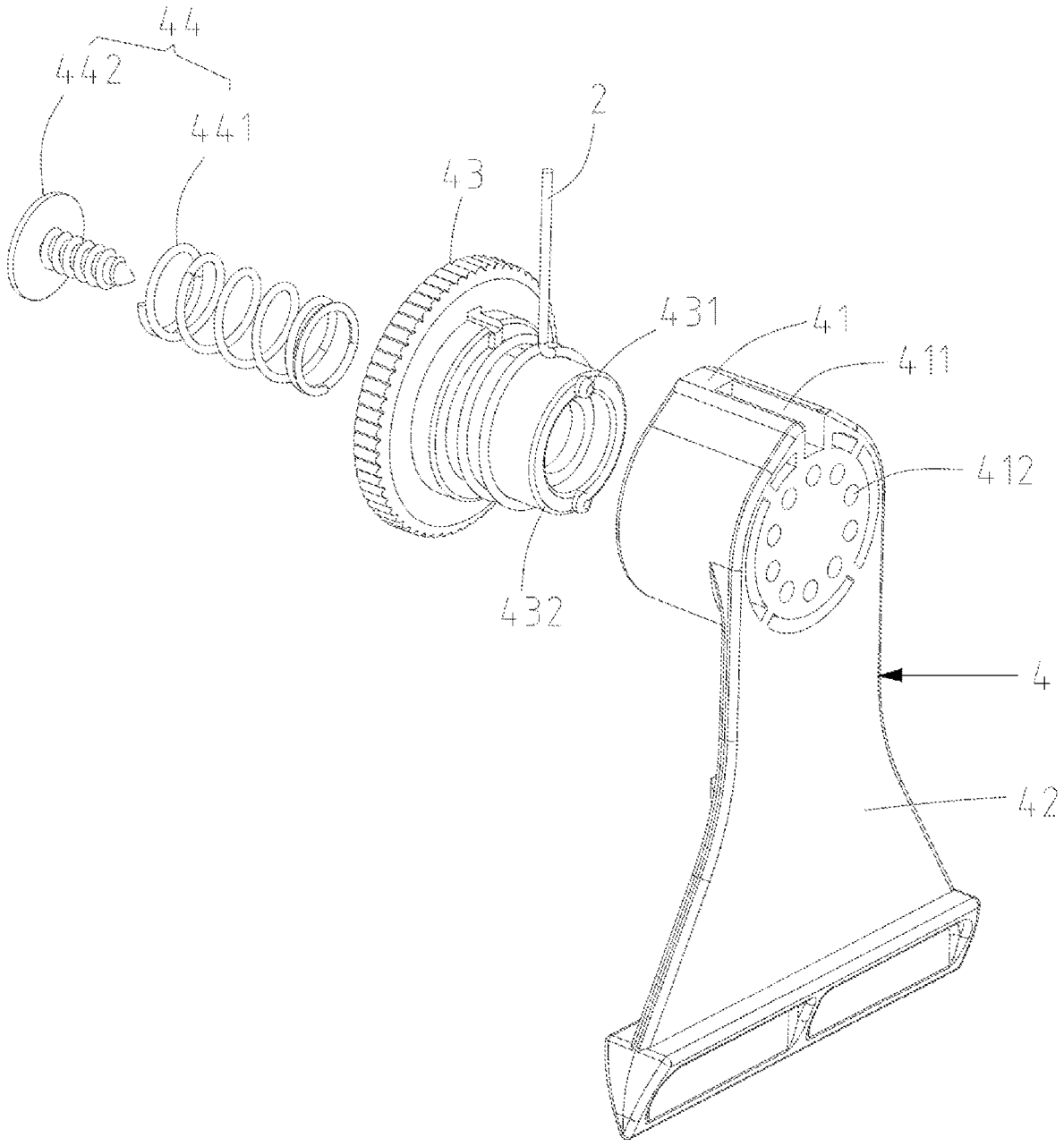
FIG. 2 is an exploded, isometric view of the drawstring adjustment device of FIG. 1.

Referring to FIGS. 1 and 2, an embodiment of a drawstring adjustment device for a curtain of the present disclosure includes a base 4 fixed to a bottom end of a curtain body 1 (shown in FIGS. 5 and 6) of the curtain and defining a shaft hole 414, a reel 43 received and rotatably mounted in the shaft hole 414 of the base 4, and a locking assembly 44 for limiting the axial displacement of the reel 43. A sidewall bounding the shaft hole 414 defines a through slot 411. The base 4 forms a plurality of first positioning portions 412 distributed in a circle about a central axis of the shaft hole 414. An end of a drawstring 2 passes through the through slot 411 of the sidewall bounding the shaft hole 414 and is wound on the reel 43. The reel 43 forms a plurality of second positioning portions 431 cooperating with the first positioning portions 412 to prevent the reel 43 from rotating.

In the embodiment of the present disclosure, the reel 43 is received and rotatably mounted in the shaft hole 414 of the base 4, the end of the drawstring 2 passes through the through slot 411 defined in the sidewall bounding the shaft hole 414 and is wound on the reel 43, the reel 43 forms the second positioning portions 431 cooperating with the first positioning portions 412 of the base 4 to prevent the reel 43 from rotating, and the locking assembly 44 limits the axial displacement of the reel 43. When a length of the drawstring 2 needs to be adjusted, the locking assembly 44 mounted to the reel 43 is pulled out of the reel 43 in a direction away from the base 4. The second positioning portions 431 of the reel 43 are disengaged from the first positioning portions 412 of the base 4. The reel 43 is rotated to adjust the position of the drawstring 2 on the reel 43, until the length of the drawstring 2 extended in the curtain body 1 reaches a desired length. The second positioning portions 431 of the reel 43 wound with the drawstring 2 are engaged in the first positioning portions 412 of the base 4 again. The locking assembly 44 is locked. The bottom end of the drawstring 2 is fixed because of the limitation of the first positioning portions 412 to the reel 43, and thus, the drawstring 2 keeps the predetermined length. Therefore, the length of the drawstring 2 of the curtain can be conveniently adjusted, to realize the retraction of the curtain body 1.

Figure 3:
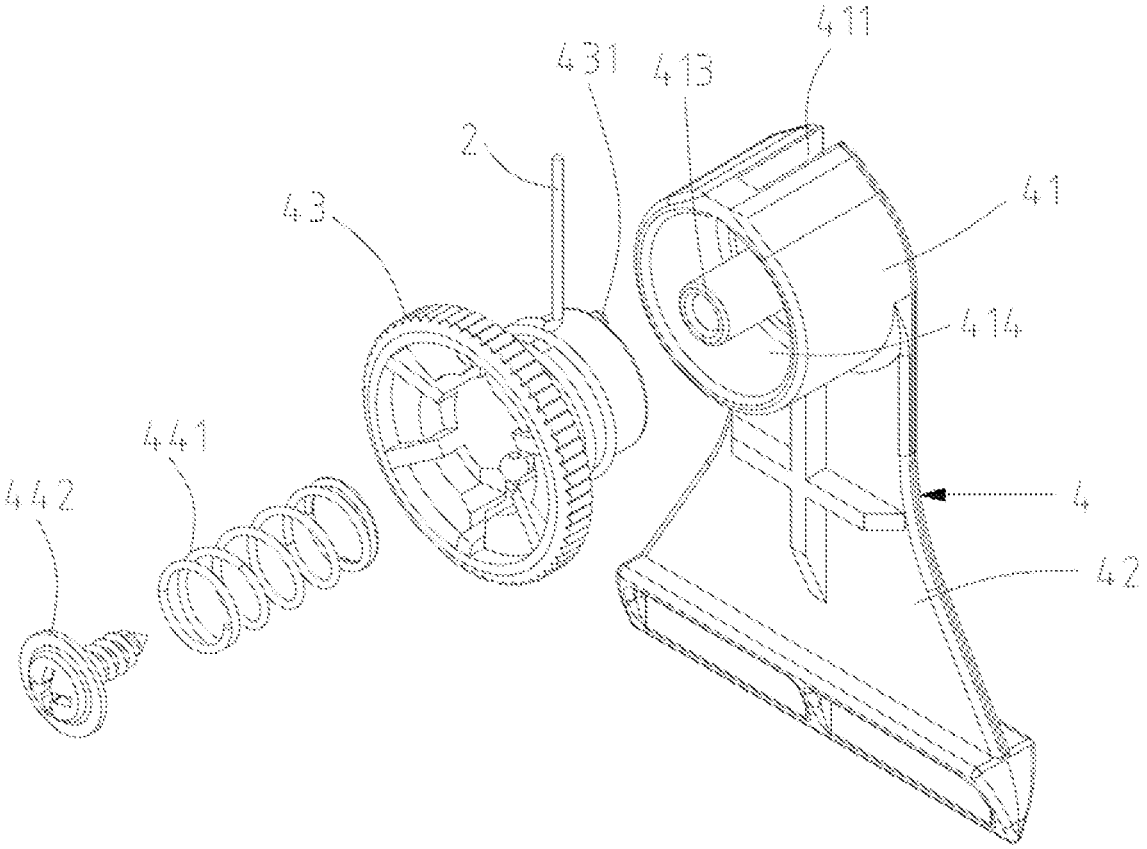
FIG. 3 is similar to FIG. 2, but viewed from another perspective.
Figure 4:
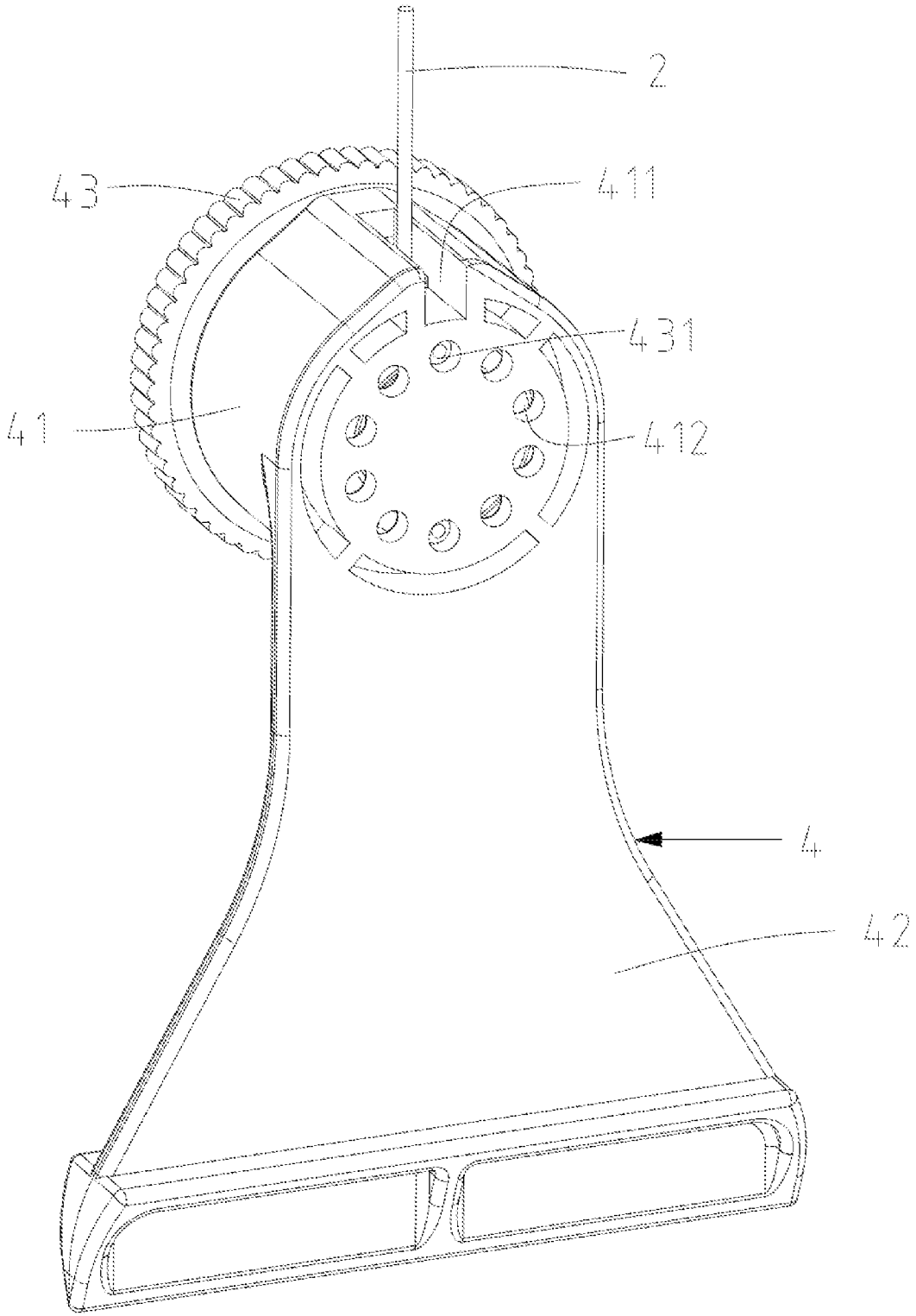
FIG. 4 is an assembled, isometric view of the drawstring adjustment device of FIG. 2.

Referring to FIGS. 3 and 4, in an embodiment of the present disclosure, a core shaft 413 extends in the shaft hole 414 from a bottom wall bounding the shaft hole 414 toward an opening of the shaft hole 414. An end wall of a distal end of the core shaft 413 defines a locking hole (not labeled). The reel 43 is cylindrical, and defines a hollow chamber, with the hollow chamber extending through opposite ends of the reel 43. The reel 43 is sleeved on the core shaft 413 with the help of the hollow chamber. The locking assembly 44 includes a locking member 442, and a positioning holder 441. An end of the locking member 442 is fixed in the locking hole, and an opposite end of the locking member 442 forms a head portion. An outer diameter of the head portion is greater than a diameter of the core shaft 413. The positioning holder 441 is arranged between an outer sidewall of the core shaft 413 and an inner sidewall bounding the hollow chamber of the reel 43. The inner sidewall bounding the hollow chamber of the reel 43 forms a block 432 adjacent to an insertion end of the reel 43. Opposite ends of the positioning holder 441 are respectively abutted against the block 432 and the head portion of the locking member 442. In the embodiment, the reel 43 is sleeved on the core shaft 413, with a gap defined between the reel 43 and the sidewall bounding the shaft hole 414 of the base 4 for accommodating the drawstring 2, which is convenient for winding the drawstring 2. The positioning holder 441 may be an elastic member, such as a coil spring or an elastic telescopic sleeve. The positioning holder 441 is mounted between the outer sidewall of the core shaft 413 and the inner sidewall bounding the hollow chamber of the reel 43 through the locking member 442 and the block 432 of the reel 43. Under the action of the positioning holder 441, the second positioning portions 431 of the reel 43 are abutted against to be engaged in the first positioning portions 412 of the base 4, so as to prevent the reel 43 from rotating and fix the bottom end of the drawstring 2. When the length of the drawstring 2 needs to be adjusted, the reel 43 is pulled away from the base 4 to compress the positioning holder 441. The second positioning portions 431 of the reel 43 are disengaged from the first positioning portions 412 of the base 4. The reel 43 is rotated to adjust the position of the drawstring 2 on the reel 43, thereby conveniently adjusting the length of the drawstring 2.

In another embodiment of the present disclosure, a core shaft 413 extends in the shaft hole 414 from a bottom wall bounding the shaft hole 414 toward an opening of the shaft hole 414. An end wall of a distal end of the core shaft 413 defines a locking hole. The reel 43 is cylindrical, and defines a hollow chamber, with the hollow chamber extending through opposite ends of the reel 43. The reel 43 is sleeved on the core shaft 413 with the help of the hollow chamber. The locking assembly 44 includes a locking member 442. An end of the locking member 442 is fixed in the locking hole, and an opposite end of the locking member 442 forms a head portion. An outer diameter of the head portion is greater than an inner diameter of the hollow chamber of the reel 43. The locking member 442 is fixed in the locking hole, and the head portion of the locking member 442 is abutted against an outer end wall of the reel 43. In the embodiment, the reel 43 is sleeved on the core shaft 413, with a gap defined between the reel 43 and a sidewall bounding the shaft hole 414 for accommodating the drawstring 2, which is convenient for winding the drawstring 2. The locking member 442 is fixed in the locking hole, and the head portion of the locking member 442 is abutted against the outer end wall of the reel 43. Therefore, the second positioning portions 431 of the reel 43 are abutted against to be engaged in the first positioning portions 412 of the base 4, so as to prevent the reel 43 from rotating and fix the bottom end of the drawstring 2. When the length of the drawstring 2 needs to be adjusted, the locking member 442 is released from the locking hole. The second positioning portions 431 of the reel 43 are disengaged from the first positioning portions 412 of the base 4. The reel 43 is rotated to adjust the position of the drawstring 2 on the reel 43, thereby conveniently adjusting the length of the drawstring 2.

In an embodiment of the present disclosure, the first positioning portions 412 are arranged on the bottom wall bounding the shaft hole 414, and the second positioning portions 431 are arranged on an end wall of the insertion end of the reel 43. In the embodiment, by providing the first positioning portions 412 on the bottom wall bounding the shaft hole 414 and providing the second positioning portions 431 on the end wall of the insertion end of the reel 43, the length of the drawstring 2 can be conveniently adjusted by rotating the reel 43.

In another embodiment of the present disclosure, an end of the reel 43 opposite to the insertion end is exposed outside the shaft hole 414, and forms an operation portion (not labeled) radially extending out from a distal end of the end opposite to the insertion end. In the embodiment, the end of the reel 43 outside the shaft hole 414 forms the operation portion for easy operation.

In an embodiment of the present disclosure, the first positioning portions 412 are arranged on a periphery bounding an orifice of the shaft hole 414, and the second positioning portions 431 are arranged on a sidewall of the operation portion facing the base 4. In the embodiment, the first positioning portions 412 arranged on the periphery bounding the orifice of the shaft hole 414 cooperate with the second positioning portions 431 arranged on the operation portion, to prevent the reel 43 from rotating. The first and second positioning portions 412 and 431 are all exposed outside the drawstring adjustment device. The length of the drawstring 2 can be easily adjusted by rotating the operation portion.

In an embodiment of the present disclosure, the first positioning portions 412 are positioning holes, and the second positioning portions 431 are positioning pins. In the embodiment, the positioning pins are engaged in the positioning holes, to prevent the reel 43 from rotating, so as to allow the drawstring 2 to keep a preset length.

In an embodiment of the present disclosure, the locking member 442 is a head screw, or the locking member 442 includes a screw, and a ring sleeved on the screw to form the head portion. In the embodiment, a wide range of the locking member 442 can be used to optimize the product structure according to actual needs.

In an embodiment of the present disclosure, the base 4 includes a seat 42 located at a bottom of the base 4 to be fixed to the curtain body 1, and a sleeve 41 extending from a top end of the seat 42. An inner chamber of the sleeve 41 forms the shaft hole 414. In the embodiment, the sleeve 41 is formed on the seat 42, and the inner chamber of the sleeve 41 forms the shaft hole 414, which facilitates the manufacture and assembly of the drawstring adjustment device.

Figure 5:
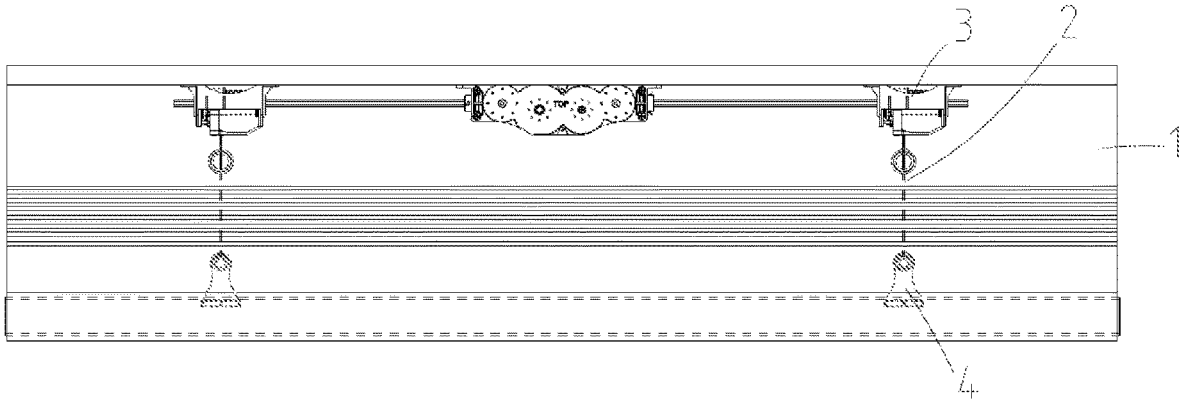
FIG. 5 is a plan view of a curtain of an embodiment of the present invention.
Figure 6:
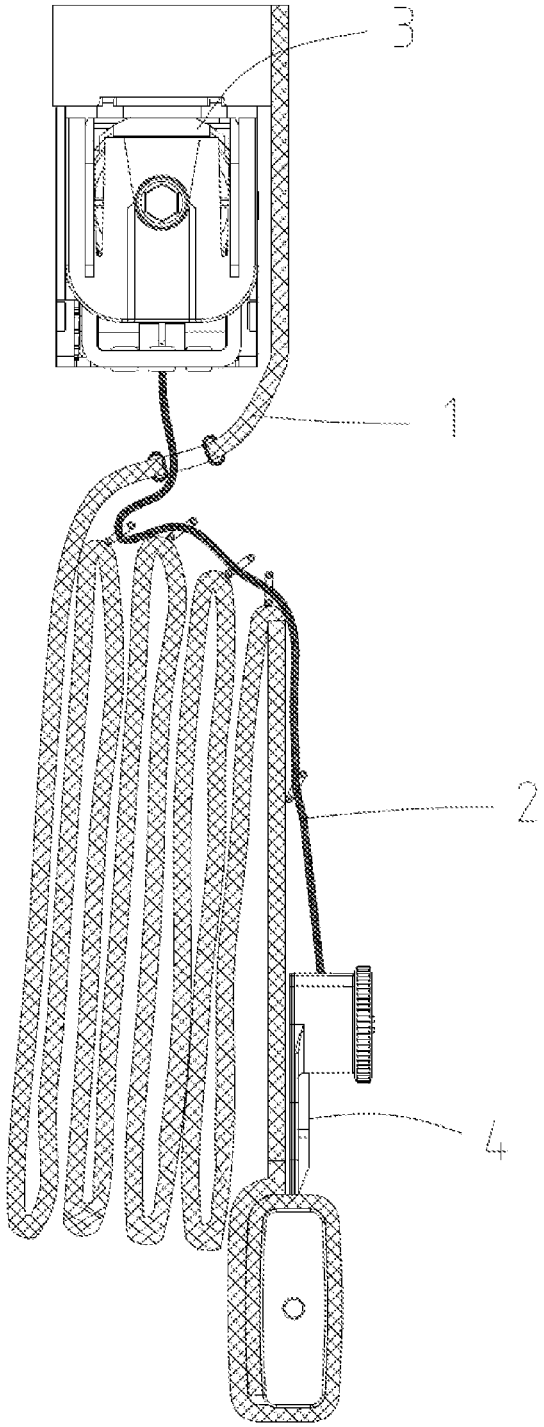
FIG. 6 is another plan view of the curtain of FIG. 5, but viewed from another perspective.

Referring to FIGS. 5 and 6, on the other hand, the present disclosure provides a curtain. The curtain includes a curtain body 1, a drawstring 2 for driving the curtain body 1 to be retracted, and a retraction device 3 for retracting the drawstring 2. The curtain further includes the drawstring adjustment device as described above.

The curtain of the embodiment of the present disclosure adopts the above-mentioned drawstring adjustment device. The reel 43 is received and rotatably mounted in the shaft hole 414 of the base 4. The end of the drawstring 2 passes through the through slot 411 of the sidewall bounding the shaft hole 414 and is wound on the reel 43. The reel 43 forms a plurality of positioning pins 431 cooperating with the positioning holes 412 defined in the base 4, to prevent the reel 43 from rotating. The locking assembly 44 limits the axial displacement of the reel 43. Therefore, the length of the drawstring 2 is fixed. When the length of the drawstring 2 needs to be adjusted, the locking assembly 44 is pulled out of the reel 43 in a direction away from the base 4. The positioning pins 431 of the reel 43 are disengaged from the positioning holes 412 of the base 4. The reel 43 is rotated to adjust the position of the drawstring 2 on the reel 43, until the length of the drawstring 2 extended in the curtain body 1 reaches the desired length. The positioning pins 431 of the reel 43 wound with the drawstring 2 are engaged in the positioning holes 412 of the base 4 again. The locking assembly 44 is locked. The bottom end of the drawstring 2 is fixed because of the limitation of the positioning holes 412 to the reel 43, and thus, the drawstring 2 keeps the predetermined length. Therefore, the length of the drawstring 2 of the curtain can be conveniently adjusted. The drawstring 2 is extended in the curtain body 1, the bottom end of the drawstring 2 is fixed to the bottom end of the curtain body 1 through the drawstring adjustment device, and the top end of the drawstring 2 is fixed to the retraction device 3, to realize the retraction of the curtain body 1.

While the embodiments of the present invention have been shown and described, it will be understood by those skilled in the art that various changes, modifications, substitutions, and variations can be made to the embodiments without departing from the spirit and scope of the invention. The scope of the invention is defined by the appended claims and their equivalents.

What is claimed is:

1. An adjustment device for a drawstring of a curtain with a curtain body, comprising:

a base fixed to a bottom end of the curtain body and defining a shaft hole, wherein a sidewall bounding the shaft hole of the base defines a through slot, the base forms a plurality of first positioning portions distributed in a circle about a central axis of the shaft hole;

a reel received and rotatably mounted in the shaft hole of the base, wherein an end of the drawstring passes through the through slot of the sidewall bounding the shaft hole and is wound on the reel, the reel forms a plurality of second positioning portions cooperating with the plurality of first positioning portions to prevent the reel from rotating; and a locking assembly for limiting an axial displacement of the reel;

wherein the plurality of first positioning portions is arranged on a bottom wall bounding the shaft hole, and the plurality of second positioning portions is arranged on an end wall of an insertion end of the reel; and wherein the plurality of first positioning portions is a plurality of positioning holes, and the plurality of second positioning portions is a plurality of positioning pins.

2. The adjustment device of claim 1, wherein a core shaft extends in the shaft hole from the bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly comprises a locking member, and a positioning holder; wherein an end of the locking member is fixed in the locking hole, and an opposite end of the locking member forms a head portion, an outer diameter of the head portion is greater than a diameter of the core shaft; the positioning holder is arranged between an outer sidewall of the core shaft and an inner sidewall bounding the hollow chamber of the reel, the inner sidewall bounding the hollow chamber of the reel forms a block adjacent to an insertion end of the reel, opposite ends of the positioning holder are respectively abutted against the block and the head portion of the locking member.

3. The adjustment device of claim 1, wherein a core shaft extends in the shaft hole from the bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly comprises a locking member; wherein an end of the locking member is fixed in the locking hole, and an opposite end of the locking member forms a head portion, an outer diameter of the head portion is greater than an inner diameter of the hollow chamber; the locking member is fixed in the locking hole, and the head portion of the locking member is abutted against an outer end wall of the reel.

4. The adjustment device of claim 1, wherein an end of the reel opposite to an insertion end of the reel is exposed outside the shaft hole, and forms an operation portion radially extending out.

5. The adjustment device of claim 2, wherein the locking member is a head screw, or the locking member comprises a screw, and a ring sleeved on the screw to form the head portion.

6. The adjustment device of claim 3, wherein the locking member is a head screw, or the locking member comprises a screw, and a ring sleeved on the screw to form the head portion.

7. The adjustment device of claim 1, wherein the base comprises a seat located at a bottom of the base to be fixed to the curtain body, and a sleeve extending from a top end of the seat, an inner chamber of the sleeve forms the shaft hole.

8. A curtain, comprising:

a curtain body;

a drawstring to drive the curtain body to be retracted;

a retraction device to retract the drawstring; and an adjustment device, comprising:

a base fixed to a bottom end of the curtain body and defining a shaft hole, wherein a sidewall bounding the shaft hole of the base defines a through slot, the base forms a plurality of first positioning portions distributed in a circle about a central axis of the shaft hole;

a reel received and rotatably mounted in the shaft hole of the base, wherein an end of the drawstring passes through the through slot of the sidewall bounding the shaft hole and is wound on the reel, the reel forms a plurality of second positioning portions cooperating with the plurality of first positioning portions to prevent the reel from rotating; and a locking assembly for limiting an axial displacement of the reel;

wherein the plurality of first positioning portions is arranged on a bottom wall bounding the shaft hole, and the plurality of second positioning portions is arranged on an end wall of an insertion end of the reel; and wherein the plurality of first positioning portions is a plurality of positioning holes, and the plurality of second positioning portions is a plurality of positioning pins.

9. The curtain of claim 8, wherein a core shaft extends in the shaft hole from the bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly comprises a locking member, and a positioning holder; wherein an end of the locking member is fixed in the locking hole, and an opposite end of the locking member forms a head portion, an outer diameter of the head portion is greater than a diameter of the core shaft; the positioning holder is arranged between an outer sidewall of the core shaft and an inner sidewall bounding the hollow chamber of the reel, the inner sidewall bounding the hollow chamber of the reel forms a block adjacent to an insertion end of the reel, opposite ends of the positioning holder are respectively abutted against the block and the head portion of the locking member.

10. The curtain of claim 8, wherein a core shaft extends in the shaft hole from the bottom wall bounding the shaft hole toward an opening of the shaft hole, an end wall of a distal end of the core shaft defines a locking hole; the reel is cylindrical, and defines a hollow chamber, with the hollow chamber extending through opposite ends of the reel, the reel is sleeved on the core shaft with the help of the hollow chamber, the locking assembly comprises a locking member; wherein an end of the locking member is fixed in the locking hole, and an opposite end of the locking member forms a head portion, an outer diameter of the head portion is greater than a diameter of an inner sidewall bounding the hollow chamber; the locking member is fixed in the locking hole, and the head portion of the locking member is abutted against an outer end wall of the reel.

11. The curtain of claim 8, wherein an end of the reel opposite to an insertion end of the reel is exposed outside the shaft hole, and forms an operation portion radially extending out.

12. The curtain of claim 8, wherein the base comprises a seat located at a bottom of the base to be fixed to the curtain body, and a sleeve extending from a top end of the seat, an inner chamber of the sleeve forms the shaft hole.

* * * * *